US007763133B2

(12) United States Patent
Thomson

(10) Patent No.: US 7,763,133 B2
(45) Date of Patent: Jul. 27, 2010

(54) TRANSPORTATION OF LIQUID PRODUCTS

(75) Inventor: Stephen Thomson, Merewether Heights (AU)

(73) Assignee: Orica Explosives Technology Pty Ltd., Melbourne (AU)

( * ) Notice: Subject to any disclaimer, the term of this patent is extended or adjusted under 35 U.S.C. 154(b) by 821 days.

(21) Appl. No.: 10/550,545

(22) PCT Filed: Mar. 26, 2004

(86) PCT No.: PCT/AU2004/000373

§ 371 (c)(1),
(2), (4) Date: Jun. 19, 2006

(87) PCT Pub. No.: WO2004/085296

PCT Pub. Date: Oct. 7, 2004

(65) Prior Publication Data

US 2006/0237492 A1 Oct. 26, 2006

(30) Foreign Application Priority Data

Mar. 28, 2003 (AU) ..... 2003901504

(51) Int. Cl.
*C06B 47/00* (2006.01)
*D03D 23/00* (2006.01)
*D03D 43/00* (2006.01)

(52) U.S. Cl. ..... 149/109.6; 149/1; 149/109.4

(58) Field of Classification Search ..... 149/109.6, 149/1, 109.4
See application file for complete search history.

(56) References Cited

U.S. PATENT DOCUMENTS

| | | | |
|---|---|---|---|
| 2,504,611 | A | 4/1950 | Zandmer |
| 4,027,760 | A | 6/1977 | Somerville |
| 4,995,499 | A | 2/1991 | Berquist |

FOREIGN PATENT DOCUMENTS

| | | | |
|---|---|---|---|
| AU | 1 370 202 | * | 10/1974 |
| DE | 2621305 | A | 12/1977 |
| DE | 3442667 | A | 5/1986 |
| EP | 0 182 661 | A2 | 5/1986 |
| GB | 1 370 202 | | 10/1974 |

* cited by examiner

*Primary Examiner*—Jerry Lorengo
*Assistant Examiner*—James E McDonough
(74) *Attorney, Agent, or Firm*—Birch, Stewart, Kolasch & Birch, LLP.

(57) ABSTRACT

A method of transporting a liquid product down a vertical conduit having an inlet provided at the top of the conduit and an outlet provided at the bottom of the conduit, which method comprises feeding the liquid product into the inlet of the conduit and contacting the liquid product with means for dissipating potential energy released by the liquid product as it is transported down the conduit so that turbulence in the liquid product at the outlet of the conduit is reduced.

14 Claims, No Drawings

TRANSPORTATION OF LIQUID PRODUCTS

The present invention relates to the transportation (delivery) of liquid products down conduits, such as pipes. The invention is particularly useful for the transportation of emulsion explosives to underground storage facilities, and the invention will be illustrated with reference to this specific application.

When a pipe is arranged vertically and filled with a liquid, gravity causes the liquid to exert a hydraulic pressure at the bottom of the pipe. This hydraulic pressure causes liquid to flow out of the bottom of the pipe. If the pipe is long, the hydraulic pressure can be high and this can lead to significant velocity and consequently turbulence in the liquid as it exits the pipe. This turbulence results in shearing of the liquid and this can be problematic if it alters the characteristics of the liquid. Heat can also be generated in the liquid.

One area where this problem is encountered is in underground mining where it is desired to transport an emulsion explosive from a surface to an underground storage facility. Shearing of the emulsion explosive can lead to changes in emulsion droplet size and, possibly, emulsion breakdown. This may render the emulsion less effective or of no use at all. Shearing of the emulsion also tends to cause a viscosity increase which can make subsequent use difficult. Conventional practice is to reduce the shearing effect by pumping the emulsion down relatively short pipes (such as less than 100 m) so that the hydraulic pressure exerted by the liquid is relatively low. For greater depths an entirely different approach tends to be adopted where the emulsion is transported in individual batches using carrier vehicles. However, for relatively large depths this would require very long "tramming" distances because of the relatively gentle gradients over which such vehicles can operate. The transport process is also very time consuming as it involves repeat journeys of the carrier vehicle between a surface supply and the intended underground storage facility. In shaft access mines such carrier vehicles may not be used since there is no ramp access to the surface. In this case the emulsion is usually transported underground in bins via the shaft cage system. However, this is also very time consuming and prevents the cage(s) being used for transport of personnel and/or other materials for prolonged periods.

The present invention seeks to solve these problems by providing a method which enables liquid products to be delivered over relatively large distances (e.g. upto 600 m) down a vertical conduit but which avoids any problems associated with shearing of the liquid product during transportation. The invention also seeks to provide a method which may be operated in a continuous fashion and which avoids large "tramming" distances or the use of cages in shaft access mines.

Accordingly, the present invention provides a method of transporting a liquid product down a vertical conduit having an inlet provided at the top of the conduit and an outlet provided at the bottom of the conduit, which method comprises feeding the liquid product into the inlet of the conduit and contacting the liquid product with means for dissipating potential energy released by the liquid product as it is transported down the conduit so that turbulence in the liquid product at the outlet of the conduit is reduced.

The crux of the present invention is the use of means for dissipating potential energy released by the liquid product as it is transported down the conduit. Without such means this potential energy is converted to kinetic energy which manifests itself as velocity, heat and turbulence as the product emerges from the outlet of the conduit. It will be appreciated that the means is essentially an energy dissipating device which prevents potential energy associated with the liquid product from being converted to kinetic energy within the liquid product. In the context of emulsion explosives it is also important that the means used does not cause heating of the liquid product. This could cause safety problems.

The means may be a pump the mechanism of which is actuated by movement of the liquid product through the pump and/or by contact of the liquid product with components of the pump. It will be appreciated that in this respect the moving liquid product does work on the pump rather than vice-versa. In this respect the pump functions as a turbine which is driven by movement of the liquid product through and/or in contact with it. Conventional pumps may be used although some modification may be required to render the pump useful in the present invention. Similarly, conventional turbines may be used and again some modification of the design thereof may be required. The general requirement of a useful pump or turbine is that it must be capable of dissipating potential energy associated with the liquid product as described herein. As an example of a pump that may be used, mention may be made of progressive cavity pumps. Such pumps are routinely used to transport emulsion explosives. It will be appreciated that in accordance with the present invention such pumps may be operated "in reverse", i.e. liquid product is fed into the pump outlet and does work in moving the pump rotor rather than vice versa.

The potential energy released by the liquid product may be converted to other forms of energy, such as electrical, mechanical and/or hydraulic energy by the "pump" and dissipated in this form. The effect is that liquid product emerging from the outlet of the conduit exhibits essentially non-turbulent flow thereby avoiding shearing.

The pump/turbine used is usually characterised by reference to a pressure rating and a suitable device may be selected with this in mind based on relevant factors such as the vertical distance over which the liquid product is to be transported. The pump/turbine may be equipped with sensors to monitor its performance and operating characteristics (such as temperature and pressure). The pump/turbine is usually operated in order to achieve a target rate of flow at the outlet of the conduit.

The means will usually be provided at the bottom of the conduit close to the outlet thereof. Positioning the means here is most effective as opposed to another location between the inlet and outlet of the conduit. For conduits having a long length more than one means may be employed to manage the potential energy released. In this case, one means will still usually be provided adjacent the outlet of the conduit.

The present invention does not rely on a pump located at the top of the conduit to cause the liquid product to be transported down the conduit. In practice the hydraulic pressure exerted by a column of liquid product in the conduit is sufficient to cause the product to be forced from the outlet of the conduit. For continuous flow liquid product is supplied to the conduit inlet to maintain the column of liquid product therein.

The invention is useful for the transportation of any liquid product the characteristics of which are adversely affected (based on the intended use of the product) by shearing associated with turbulent flow of the liquid product. As noted the invention is particularly well suited to the transport of an emulsion explosive form a surface storage facility, such as a mobile vessel, to an underground storage facility. Emulsion explosives are well known in the art and usually comprise water-in-oil type emulsions in which the oil phase is a fuel and the aqueous phase a salt solution of oxidiser compounds. The present invention is intended to reduce or avoid altogether any changes in the characteristics of the emulsion explosive which would otherwise have an adverse effect on the suitability of the emulsion for its intended application. Thus, the present invention may be used to reduce or avoid altogether breakdown of the emulsion and/or changes to the droplet size and/or viscosity of the emulsion. The efficacy of the invention may be assessed by reference to one or more of these characteristics, and the manner in which the invention is practiced may be varied should transportation of the emulsion result in unacceptable changes in the initial properties and characteristics of the emulsion.

During transportation of an emulsion explosive a viscosity increase may be observed. This can be tolerated provided that it does not result in the emulsion being unworkable. After having been transported underground in accordance with the present invention, the emulsion explosvie is then transported, usually by a pump, to the site of its intended use. Any increase in viscosity must not render the emulsion difficult to transport for ultimate use. Preferably, no change in viscosity is observed (within measurement tolerances) as a result of transportation of the emulsion down the conduit. The initial viscosity of an emulsion explosive is usually from 2,000-200,000 cP at 25° C., for instance from 25,000-40,000 cP at 25° C.

As noted, some limited shearing of the liquid product can be tolerated during transportation in accordance with the invention provided that the viscosity increase does not make ultimate use of the product untenable. For an emulsion explosive the increase in viscosity that may be tolerated will depend upon the initial viscosity of the emulsion and the viscosity at which the emulsion would become unworkable. Usually, a viscosity increase of upto about 5,000 cP at 25° C. may be tolerated.

Emulsion explosives require sensitisation prior to use and this is usually done immediately before use by gassing of the emulsion or by inclusion in the emulsion of microballoons (usually glass or plastic). Such sensitisation techniques are conventional in the art. The emulsion explosive may be transported unsensitised. This said, it is possible to transport an emulsion explosive that has been sensitised by microballoons provided that care is taken to ensure that the integrity of the microballoons is preserved during transportation of the sensitised emulsion. For transportation over large distances it may be appropriate to use microballoons that are more robust than microballloons that one might use for transportation over short distances.

The conduit is invariably a pipe. The pipe is usually provided vertically in the strict sense, although the invention may be practised using pipes which are inclined to the vertical. When transporting an emulsion explosive the pipe is usually from 100-300 mm, for instance from 100-150 mm, in diameter. Larger diameter pipes are used when the liquid product is to be transported over greater distances. There is less pressure drop and less resistance to flow associated with larger diameter pipes.

The invention may enable a liquid product to be transported over relatively large vertical distances without shearing of the liquid product at the outlet of the conduit. For instance, the invention may be used to transport an emulsion explosive through a pipe upto 600 m in length. Usually, the length of the pipe exceeds 100 m.

As noted, the invention is especially well-suited to the transportation of emulsion explosives and the following details illustrate how the invention may be used in this respect.

A pipe having a diameter from 10-150 mm is provided between the surface and the inlet to an underground storage unit. The unit is typically provided at a depth of 100-600 m. Emulsion is delivered from a surface supply vessel into the pipe via an inlet, thereby filling the pipe. A pump/turbine having a rating of about 1,500 psi, for example about 1000 psi is provided at the bottom of the pipe in order to dissipate potential energy released as the emulsion flows down the pipe. The pump/turbine also controls the flow rate of the pipe outlet to between 300-500 kg/min. The emulsion has a viscosity of about 30,000 cP and 25° C. The emulsion emerging from an outlet provided at the bottom of the pipe feeds an underground storage facility where the emulsion is stored in ungassed form ready for use. When required, the emulsion may be transported to the blasting face for sensitisation and blasthole loading.

The claims defining the invention are as follows:

1. A method of transporting an emulsion explosive down a vertical conduit having an inlet provided at the top of the conduit and an outlet provided at the bottom of the conduit, which method comprises feeding the emulsion explosive into the inlet of the conduit and contacting the emulsion explosive with means for dissipating potential energy released by the emulsion explosive as it is transported down the conduit so that turbulence in the emulsion explosive at the outlet of the conduit is reduced in order to reduce or avoid breakdown of the emulsion explosive and/or changes in viscosity and/or changes in droplet size of the emulsion explosive.

2. A method according to claim 1, wherein the conduit is a pipe.

3. A method according to claim 2, wherein the pipe is from 100 to 300 mm in diameter.

4. A method according to claim 2, wherein the pipe is from 100 to 600 m in length.

5. A method according to claim 1, wherein no change in viscosity of the emulsion explosive is observed after transportation of the emulsion explosive down the conduit.

6. A method according to claim 1, wherein the droplet size of the emulsion explosive is unaffected by transportation down the conduit.

7. A method according to claim 1, wherein before being transported the emulsion explosive has a viscosity of from 2,000 to 200,000 cP at 25° C.

8. A method according to claim 1, wherein the means for dissipating potential energy is an energy dissipating device which prevents potential energy associated with the liquid product from being converted to kinetic energy within the liquid product.

9. A method according to claim 1, wherein the means for dissipating potential energy is a pump or turbine the mechanism of which is actuated by movement of the liquid product through the pump or turbine and/or by contact of the liquid product with components of the pump or turbine.

10. A method according to claim 9, wherein the potential energy released by the liquid product is converted to electrical, mechanical and/or hydraulic energy by the pump or turbine and dissipated in this form.

11. A method according to claim 1, wherein the means for dissipating potential energy is provided at the bottom of the conduit close to the outlet thereof.

12. A method according to claim 1, wherein the emulsion explosive is being transported from a surface storage facility to an underground storage facility.

13. The method according to claim 2,wherein the pipe has a diameter of 100-300 mm.

14. The method according to claim 1, wherein the viscosity of the emulsion explosive at the outlet of the conduit is no more than about 5,000 cPa at 25° greater than the viscosity of the emulsion explosive that is fed into the inlet.

* * * * *